US006215413B1

(12) United States Patent
Gaskill

(10) Patent No.: US 6,215,413 B1
(45) Date of Patent: Apr. 10, 2001

(54) USER SELECTABLE RECEIVER ADDRESSES FOR WIRELESS COMMUNICATION SYSTEMS

(75) Inventor: Garold B. Gaskill, Tualatin, OR (US)

(73) Assignee: Seiko Communication Systems, Beaverton, OR (US)

( * ) Notice: Subject to any disclaimer, the term of this patent is extended or adjusted under 35 U.S.C. 154(b) by 702 days.

(21) Appl. No.: 08/569,976

(22) Filed: Dec. 8, 1995

(51) Int. Cl.[7] ..... H04Q 7/00

(52) U.S. Cl. ..... 340/825.44; 340/825.52; 370/313

(58) Field of Search ..... 340/825.52, 825.44, 340/825.07, 825.2, 825.21, 825.22, 825.47; 455/33.1, 38.2, 38.4, 49.1, 54.1, 132, 68, 70; 370/310, 312, 313, 347, 442

(56) References Cited

U.S. PATENT DOCUMENTS

| | | | | |
|---|---|---|---|---|
| 4,392,242 | * | 7/1983 | Kai | 455/33 |
| 4,713,808 | | 12/1987 | Gaskill et al. | 370/94 |
| 4,875,038 | | 10/1989 | Siwiak et al. | 340/825 |
| 4,882,579 | | 11/1989 | Siwiak | 340/825 |
| 4,891,637 | | 1/1990 | Siwiak et al. | 340/825 |
| 4,897,835 | | 1/1990 | Gaskill et al. | 370/94.1 |
| 4,928,096 | | 5/1990 | Leonardo et al. | 340/825 |
| 4,940,963 | | 7/1990 | Gutman et al. | 340/313 |
| 4,951,044 | | 8/1990 | Nelson et al. | 340/825 |
| 4,964,121 | * | 10/1990 | Moore | 370/100.1 |
| 5,070,329 | | 12/1991 | Jasinaki | 340/825 |
| 5,117,460 | | 5/1992 | Berry et al. | 381/41 |
| 5,124,697 | | 6/1992 | Moore | 340/825 |
| 5,142,279 | | 8/1992 | Jasinski et al. | 340/825 |
| 5,142,692 | | 8/1992 | Owen | 455/48 |
| 5,148,469 | | 9/1992 | Price | 379/57 |
| 5,150,110 | | 9/1992 | Breeden | 340/825 |
| 5,153,582 | | 10/1992 | Davis | 340/825 |
| 5,155,479 | | 10/1992 | Ragan | 340/825 |
| 5,159,331 | | 10/1992 | Park et al. | 340/825 |
| 5,162,790 | | 11/1992 | Jasinski | 340/825 |
| 5,166,932 | | 11/1992 | Hoff et al. | 370/95.1 |
| 5,170,487 | | 12/1992 | Peek | 455/45 |
| 5,185,604 | | 2/1993 | Nepple et al. | 340/825.44 |
| 5,187,470 | | 2/1993 | King et al. | 340/825.44 |
| 5,189,413 | | 2/1993 | Gaskill et al. | 340/825.44 |
| 5,220,366 | | 6/1993 | King | 354/76 |
| 5,260,700 | | 11/1993 | Merchant et al. | 340/825.44 |
| 5,311,516 | | 5/1994 | Kuznicki et al. | 370/94.1 |
| 5,398,021 | * | 3/1995 | Moore | 340/825.27 |

OTHER PUBLICATIONS

"High Speed Subcarrier Is Wave of Future" by Lyle Henry, Guest Commentary, *Radio World*, Jun. 1, 1994.

* cited by examiner

*Primary Examiner*—Michael Horabik
(74) *Attorney, Agent, or Firm*—Elmer Galbi

(57) ABSTRACT

Selectable receiver addressing is used to control how messages are output from different receivers. Users selectively enable and disable personal addresses in the receiver. The receiver polls time slots where the data for enabled addresses may be transmitted. Enabled addresses are compared with transmitted receiver addresses. If the transmitted address matches one of the enabled receiver addresses, the message is output to the receiver user. If the transmitted address does not match the receiver address, the message is not processed and, accordingly, the receiver operator is not disturbed.

4 Claims, 8 Drawing Sheets

| CONTROL DATA |
| --- |
| LOAD ADDRESS X<br>DELETE ADDRESS X<br>ENABLE ONLY ADDRESS X<br>LOAD ADDRESSES X & Y<br>ENABLE ADDRESS X<br>DISABLE ADDRESS X |

USER SELECTABLE RECEIVER ADDRESSES FOR WIRELESS COMMUNICATION SYSTEMS

BACKGROUND OF THE INVENTION

This invention relates generally to wireless communication systems and more particularly to an RF receiver with user selectable receiver addressing.

Present paging systems identify messages for pager receivers with a pager address number. The address number matches a unique address permanently stored in the pager receiver. Pager messages and associated pager addresses are reformatted into a time division multiplexed data stream and transmitted over a radio frequency (RF) signal. The pager receiver monitors transmitted signals for messages with a transmitted address that matches the receiver address. If a message includes a transmitted address that corresponds with the receiver address, the message is processed and displayed on the pager receiver.

Multiple addresses exist in some receivers but the multiple addresses are used for group services or provide different functions such as selecting between voice or data. The multiple addresses are not selectable by the pager user.

A single pager receiver is often used by more than one person. For example, if the pager is used while driving a car, the pager user depends on the current car driver and car passengers. When multiple people use the same pager receiver, every message transmitted to the pager receiver is displayed. Thus, the person currently driving the car receives all messages for family members. However, the driver may not want to be disrupted by pager messages sent to other family members.

In another example, a father, while carrying a pager in a business meeting, may not want to receive messages directed to his daughter. Further, many pager messages give little information identifying the message sender. Thus, the father may waste time responding to messages directed to his daughter, son or wife.

Different persons each having their own personal pager receiver may each need to receive pager messages transmitted to a common telephone number. For example, workers at the same factory may each need to respond to pager messages sent to a common work number. Each employee may also want to receive personal pager messages unrelated to the work messages.

While some employees receive both work-related pager messages and personal pager messages during work hours, some employees may not want to receive work-related pager messages during off hours or the personal pager messages of others during work hours. Thus, the pager user must carry two different pager receivers, one pager receiver for work-related messages and a second pager receiver for personal-related messages.

In a similar manner, cellular telephone calls are identified by a unique telephone number permanently stored in a cellular telephone. If the cellular phone is shared by different family members, calls sent to one family member may be answered by other family members currently in possession of the cellular telephone. Cellular telephone users are charged a fee each time a cellular phone call is answered. Thus, time and money is wasted when cellular telephone calls are answered by the wrong family member.

Cellular telephones can also operate with different personality modules which each store a different cellular telephone number. The current user of the cellular telephone snaps his or her personality module into a cellular telephone. The cellular telephone then receives phone calls for the phone number matching the currently inserted personality module.

The personality modules cannot select between multiple authorized receiver addresses previously stored in the cellular telephone. Thus, the personality modules can then be used by anyone even without proper authorization. If lost or stolen, the owner of the lost personality module may be charged for cellular telephone calls made by others on any telephone. Thus, personality modules create a security risk if lost or stolen.

Accordingly, a need remains for selectively and securely changing multiple receiver addresses in wireless RF receivers according to the current receiver user.

SUMMARY OF THE INVENTION

Selectable receiver addressing is used to control how messages are output from different receivers. Receiver users selectively enable and disable personal addresses in the receiver. The receiver turns on for brief periods of time corresponding with time slots in digitally transmitted data. The receiver is synchronized to turn on during transmission time slots where data may be transmitted having associated transmitted receiver addresses matching any one of the enabled addresses stored in the receiver.

If a transmitted receiver address matches one of the stored and enabled receiver addresses, the message is supplied to the receiver output. If the transmitted address does not match the stored receiver address, the message is not supplied and accordingly the receiver user is not disturbed.

Selectable receiver addressing increases communication efficiency and functionality of pager receivers and other wireless receiving devices by customizing each receiver to the current receiver user. Since messages are selectively output from each receiver, the current user can prevent interruptions from messages for others while also directing messages from other receiver devices to the receiver device currently in the user's possession. As a result, fewer pager receivers can be used to more accurately relay messages to the correct person.

The receiver addresses are enabled and disabled with select and deselect buttons or through other user input devices that serve to identify the current receiver user. For example, the same system that identifies a car operator, controls car mirrors and controls the position of a car seat can be used to select the personal receiver addresses. The processor thus enables the personal receiver address associated with the current car user.

In turn, the receiver polls for messages during time periods corresponding with transmitted receiver addresses matching the personal receiver address of the car user.

Other devices used to automatically identify the receiver user include infrared (IR) signals transmitted from a personal wrist watch or a personal identification code read with a bar code reader. The IR signal or bar code reader transmits the user identification code to the receiver which in turn enables an associated receiver address.

Alternatively, receiver addresses and associated receiver commands are transmitted on the same RF signals carrying pager messages. The receiver user directs a transmitter clearinghouse to send new receiver addresses and associated command codes. The receiver reads the command codes and, if necessary, changes the currently stored receiver addresses. The receiver then polls for messages having message addresses matching the new set of enabled receiver addresses.

Receiver addresses are also enabled and disabled according to the time of day. In one embodiment, a receiver address is automatically enabled on a first pager receiver during a first time period and the same receiver address is automatically enabled on a second pager receiver during a second time period. Thus, two people can carry different pager receivers and receive messages for the same receiver address at different selected time periods.

Selectable receiver addresses are also incorporated into two-way communication systems such as cellular telephones. A cellular telephone user selectively enables and disables a personal address in the cellular phone. Phone messages with transmitted addresses not matching the enabled receiver address are either not processed by the cellular phone or relayed to an alternative phone number, such as a home phone number. Thus, the cellular phone user is not disrupted by phone calls for others.

The foregoing and other objects, features and advantages of the invention will become more readily apparent from the following detailed description of a preferred embodiment of the invention which proceeds with reference to the accompanying drawings.

DETAILED DESCRIPTION

Figure 1:
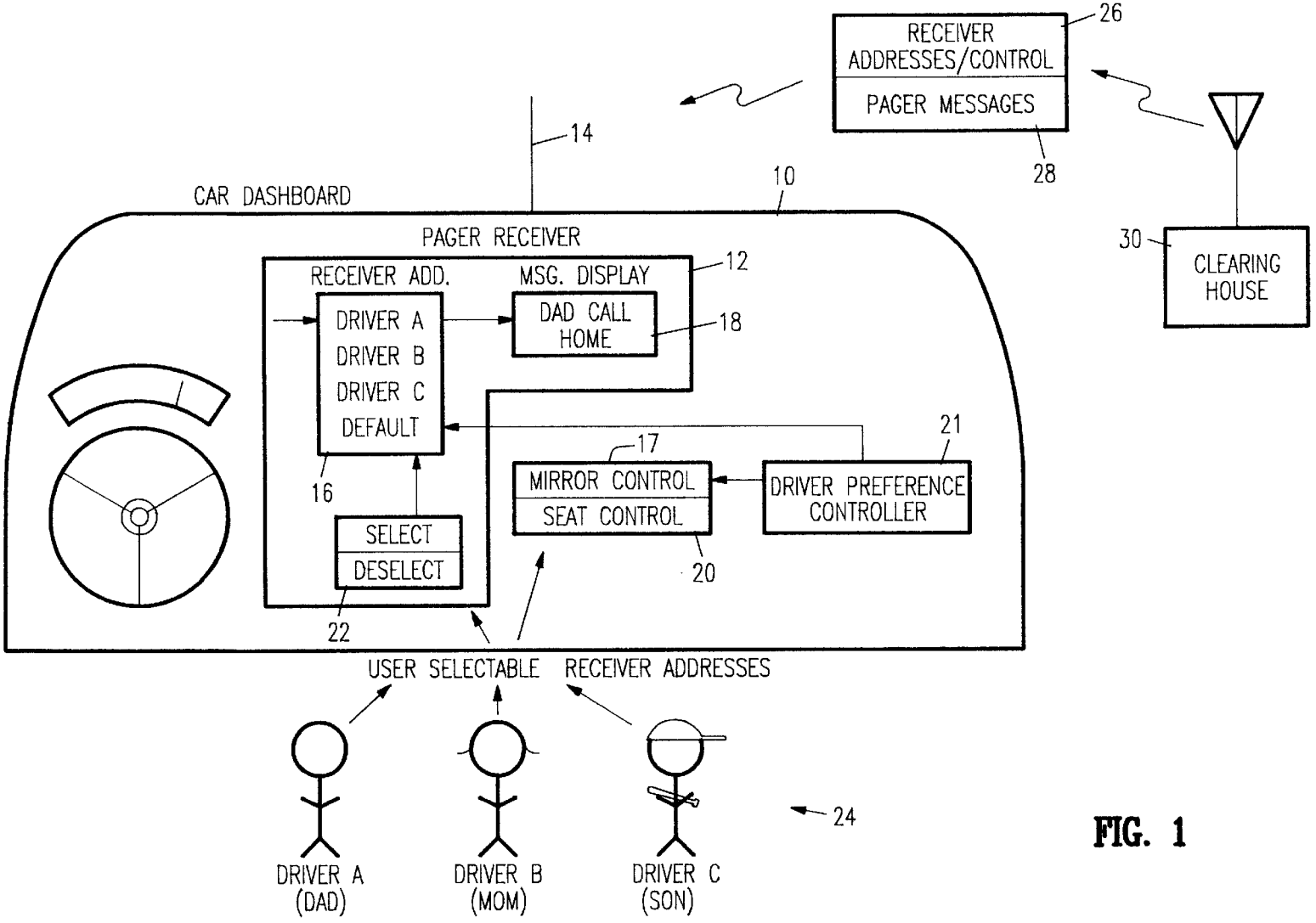
FIG. 1 is a diagram showing a wireless car pager receiver including user selectable receiver addressing according to one embodiment of the invention.

FIG. 1 is a diagram showing a pager receiver 12 with programmable user addressing according to the invention mounted in a car 10. The pager receiver 12 stores multiple user addresses 16 that are manually selectable though select and deselect buttons 22 or automatically selectable through driver preference controller 21. A message clearinghouse 30 transmits receiver addresses and associated control data 26 and pager messages 28 to the pager receiver 12. Transmission of pager messages from a clearinghouse 30 to a pager receiver and pager message formats are discussed in detail in U.S. Pat. No. 4,713,808 to Gaskill et al. entitled *Watch Pager System and Communication Protocol* and is herein incorporated by reference.

Each stored receiver address 16 identifies a different authorized user of the pager receiver 12. In FIG. 1, the car 10 is used by any member of a family which includes driver A (Dad), driver B (Mom) and driver C (Son). Because drivers may not want to receive or reply to pager messages addressed to others, each driver can select or deselect which receiver addresses 16 are enabled and disabled, in turn, selecting which messages are supplied to a message display 18. The current set of available receiver addresses 16 is defined as a menu.

A first method for selecting receiver addresses comprises user select buttons 22. The current car driver 24 is shown the authorized receiver addresses 16 on message display 18. The driver then scrolls down the menu 16 selecting or deselecting any combination of receiver address 16. For example, when the father is alone in car 10, he may only enable the receiver address for driver A. In turn, messages are only output to message display 18 when the message has an associated transmitted receiver address matching the enabled stored receiver address for driver A.

Stored receiver addresses 16 are also enabled and disabled according to control signals from the driver preference controller 21. Driver preference controller 21 is coupled to various user adjustable devices in the car 10 such as the radio (not shown), rear and side view mirror controller 17 and car seat controller 20. The driver preference controller 21 receives an identification code for the current driver and then automatically adjusts the various user adjustable devices 17 and 20 according to prestored parameters for the identified driver. Driver preference controllers are well known to those skilled in the art and are therefore not described in detail.

The output from driver preference controller 21 used for controlling the mirror controller 17 and seat controller 20 is also input to the receiver pager 12. The receiver pager 12 enables the stored receiver address corresponding with the driver preference control signals. Thus, a receiver address is automatically enabled without manually using select and deselect buttons 22.

Another method for changing receiver addresses comprises transmitting receiver addresses and control data from clearinghouse 30. A user may want to permanently remove a receiver address or add a new receiver address to menu 16. For example, driver C (Son) may leave home or start driving another car. Clearinghouse 30 is notified to remove or permanently disable the receiver address for driver C from menu 16. The clearinghouse 30 transmits control data 26 to receiver 12. Control data 26 includes commands that direct pager receiver 12 to delete or disable the receiver address for driver C from menu 16.

Selectable receiver addressing provides more efficient use of receiver pagers. Different users can program different paging devices so that messages are received only with the paging device currently in the user's possession. For example, a user may have access to a portable clip-on pager device (not shown) and the pager receiver in car 10. If the user forgets the portable pager device while driving in car 10, messages sent to the portable clip-on paging device would not be received and acted upon until the driver returns to the location where the portable paging device was last placed.

With the system shown in FIG. 1, the user simply enables a receiver address in pager receiver 12 having the same receiver address currently enabled in the portable clip-on paging device. Thus, the user can instantly receive pager messages in car 10 which are normally directed to another paging device.

Figure 2:
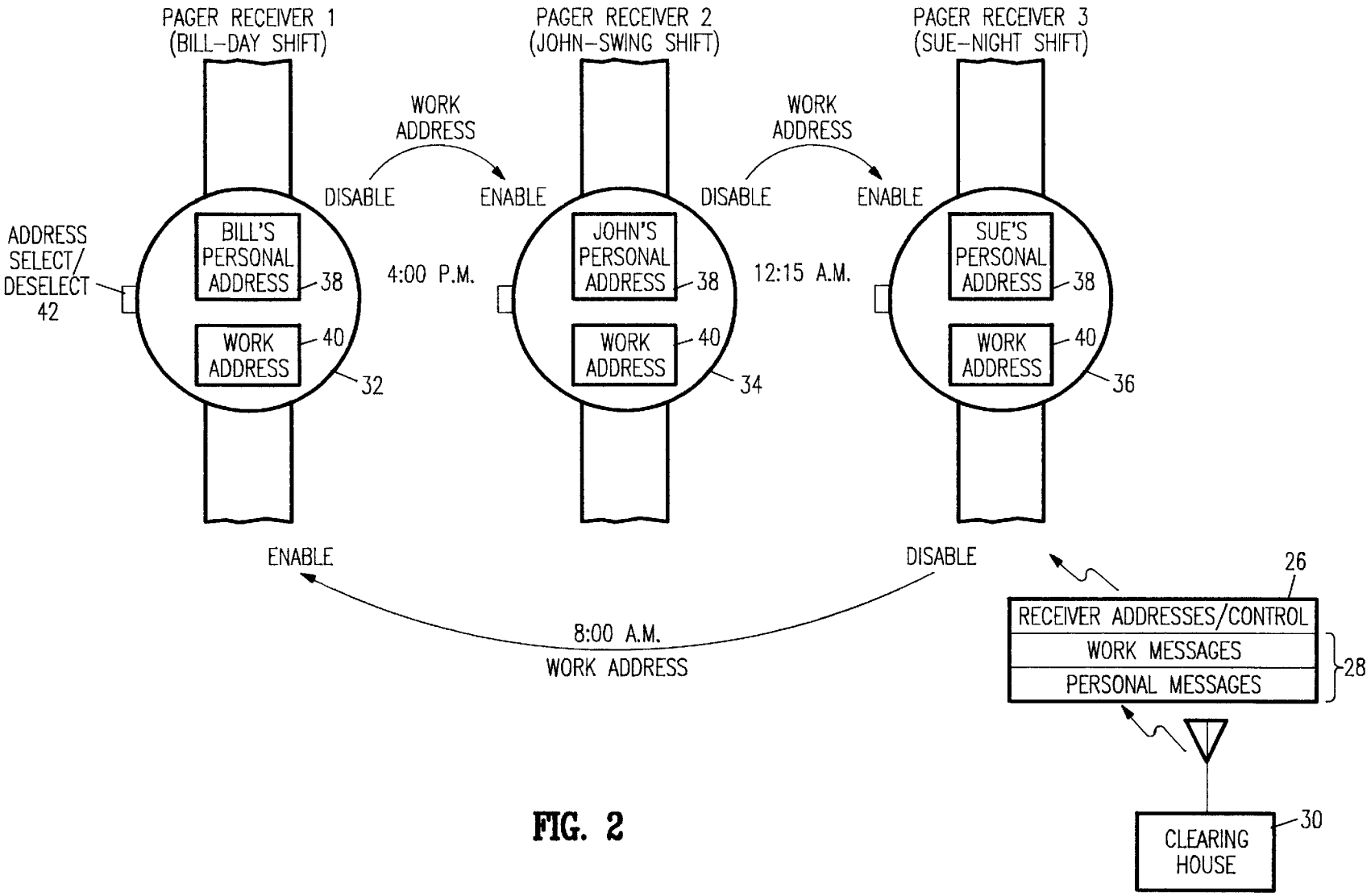
FIG. 2 is a diagram of multiple wireless pager receivers each having programmable receiver addressing according to another embodiment of the invention.

FIG. 2 is a diagram of three pager receivers 32, 34, and 36 each having programmable receiver addressing according to another embodiment of the invention and each mounted inside a wrist watch. Each receiver includes two selectable receiver addresses. The first receiver address 38 is a personal address for receiving personal pager messages. The second receiver address 40 is a work address for receiving work-related pager messages. A button 42 on each watch pager manually enables or disables work address 40. Similar to the system in FIG. 1, a clearinghouse 30 transmits both receiver addresses and control data 26 and pager messages 28 to any of the watch pagers 32, 34 and 36.

Receiver addresses are enabled and disabled similar to the system shown in FIG. 1 either manually with button 42 or automatically from the control data 26 transmitted from clearinghouse 30.

Receiver addresses can also be enabled and disabled automatically according to the time of day. Either a timer located in the watch pagers 32, 34 and 36 (FIG. 3) or a timer (not shown) located at clearinghouse 30 enables receiver addresses on different watch pagers.

To explain further, a first person (Bill) wears watch pager 32 and is normally at work from 8:00 a.m. through 4:00 p.m. A second person (John) wears watch pager 34 and is normally at work from 4:00 p.m. through 12:15 a.m. A third person (Sue) wears watch pager 36 and is normally at work from 12:15 a.m. through 8:00 a.m.

Watch pager 32 is either programmed so that receiver work address 40 is enabled in watch pager 32 between 8:00 a.m. and 4:00 p.m. Similarly, the receiver work address 40 is enabled in watch pager 34 between 4:00 p.m. and 12:15 a.m. and receiver work address 40 is enabled in watch pager 36 between 12:15 a.m. and 8:00 a.m.

Thus, Bill, John and Sue only receive work pager messages while on the job and are not disturbed by work messages while off duty. The button 42 overrides the above-described timing sequence. Thus, any of the three watch pagers can be commanded to display work messages even when the worker is normally off-duty.

Figure 3:
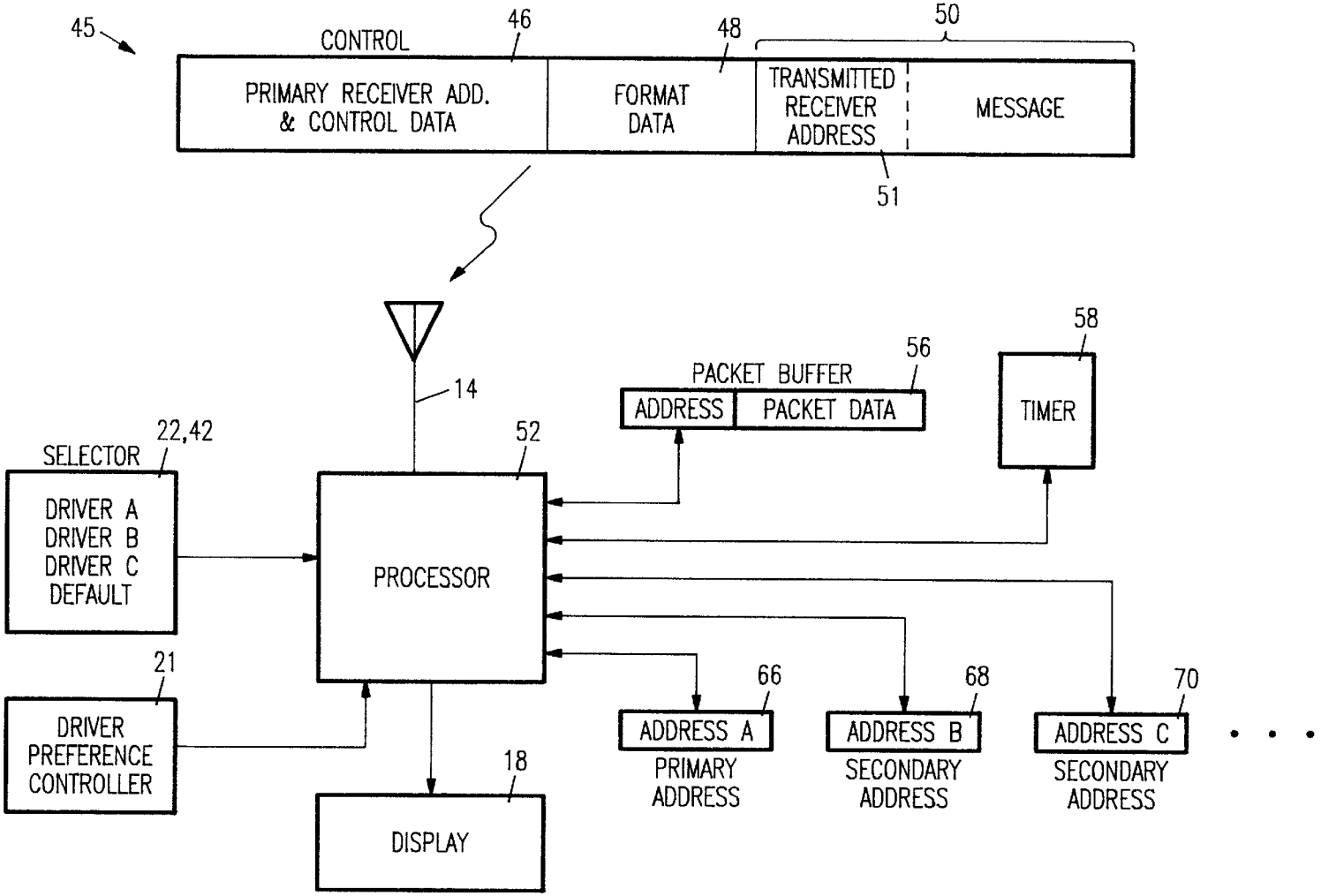
FIG. 3 is a detailed schematic diagram of the receivers shown in FIGS. 1 and 2.

FIG. 3 is a detailed diagram of the pager receivers shown in both FIGS. 1 and 2. A processor 52 is coupled to a manual selector such as the buttons 22 shown in FIG.1 or the button 42 shown in FIG. 2. For the car pager 10 shown in FIG. 1, electrical signals from the driver preference controller 21 are coupled to processor 52. A packet buffer 56 is coupled to processor 52 and stores the receiver addresses, control data and message data transmitted from clearinghouse 30 (FIGS. 1 and 2) received through an antenna 14.

Storage location 66 is coupled to processor 52 and permanently stores a primary address which uniquely identifies the receiver. Storage locations 68 and 70 are coupled to processor 52 and store secondary addresses associated with different selectable user addresses. Display 18 is coupled to processor 52 and displays pager messages having an address matching one of the enabled addresses in storage locations 66, 68 or 70.

Figures 5A, 5B:
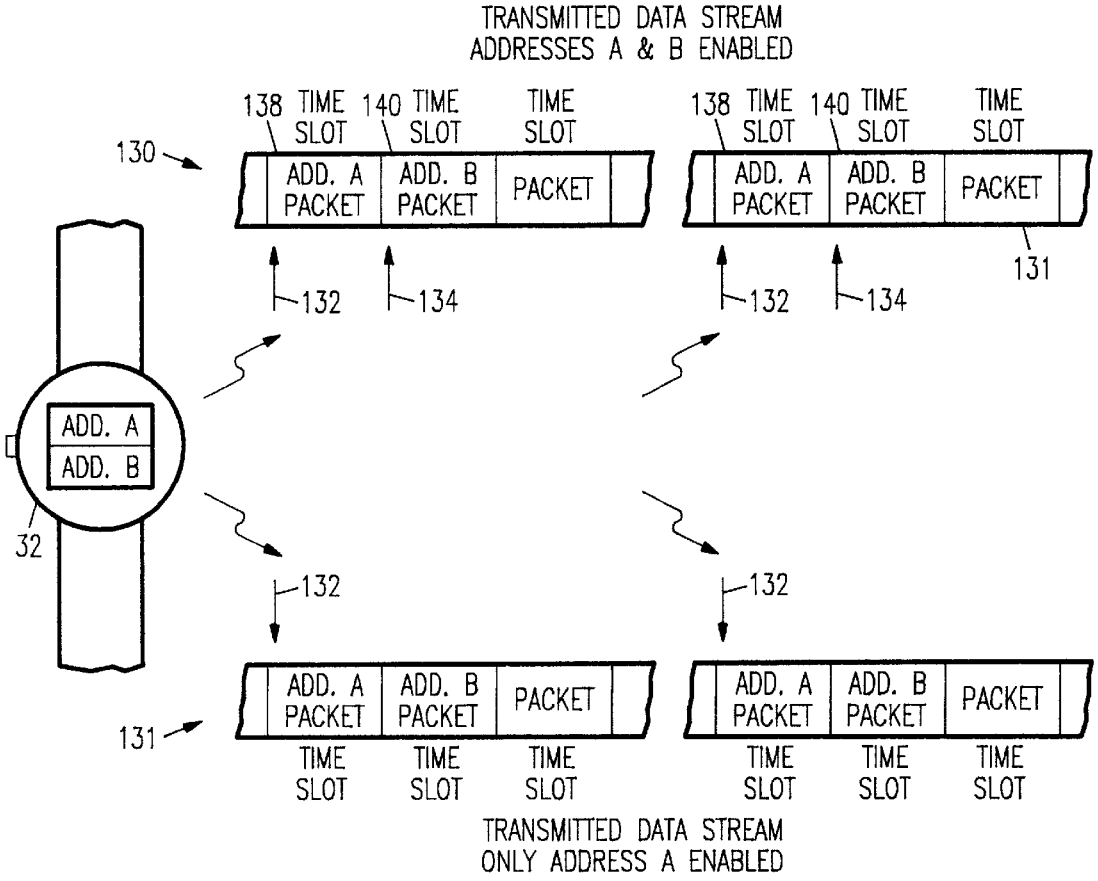
FIG. 5A is a diagram showing some control data addressing commands transmitted by a clearinghouse for changing receiver addresses.
FIG. 5B is a diagram showing variable receiver polling protocols for selected receiver addresses.

A timer 58 is coupled to processor 52 and serves to control receiver polling according to selected receiver addresses as explained in detail in FIG. 5B.

Packet 45 is a diagram showing one format for data transmitted from the clearinghouse 30 (FIGS. 1 and 2) to the pager receiver processor 52. Packet 45 includes a control section 46 that contains a primary address for a target pager receiver and control data that determine how receiver addresses are enabled and disabled. Format section 48 contains information regarding the format for messages contained in data section 50. Data section 50 can contain any of the following: pager messages, an associated transmitted receiver address 51 and new receiver addresses that are loaded into storage locations 68 and 70. The format for the TDMA data packets is described in detail in U.S. Pat. No. 4,713,808 to Gaskill et al.

Figure 4:
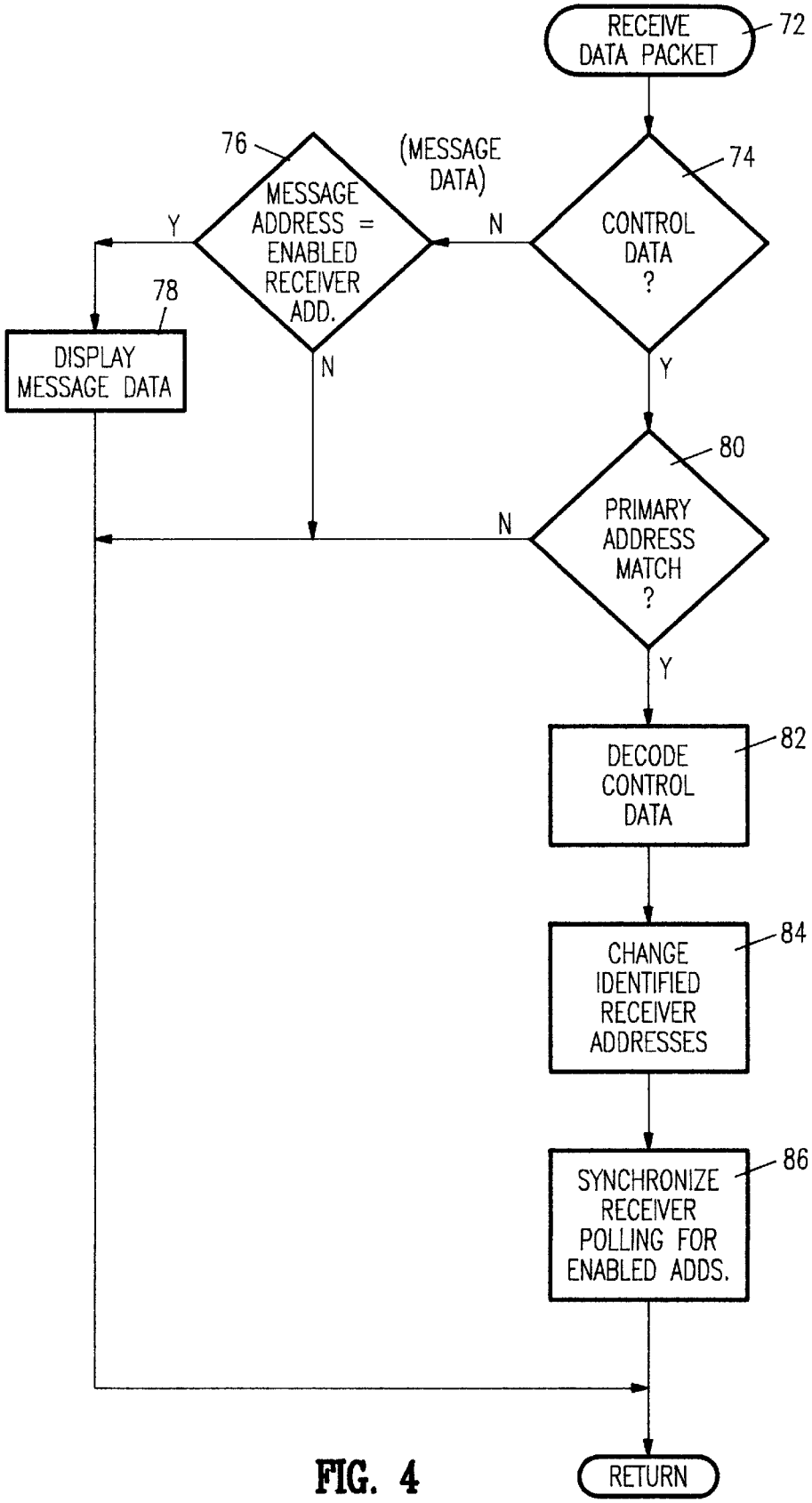
FIG. 4 is a step diagram showing a method for processing control and message data for the receivers shown in FIGS. 1 and 2.

FIG. 4 explains how message and control data is processed in processor 52. Step 72 temporarily stores packets 45 into packet buffer 56 (FIG.3). Decision step 74 looks for a bit combination in the control section 46 that identifies the packet 45 as containing either control data or message data. If the data section 50 contains control data, decision step 80 compares the primary address transmitted in control section 46 with the primary address stored in storage location 66 (FIG. 3). If the primary addresses do not match, the control data is not intended for the receiver and decision step 80 returns to step 72 to poll for the next packet 45.

If the primary address in control section 46 matches the primary address in storage location 66, step 82 decodes the control data. Step 84 loads, deletes, enables or disables receiver addresses in storage locations 66, 68 and 70 according to commands decoded for the control data as further described in FIG. 5A. Step 86 synchronizes the receiver to poll transmitted signals during time slots that may contain data for the enabled receiver addresses. Step 86 is described in detail in FIG. 5B. The processor 52 then returns to step 72 to poll for subsequently transmitted packets 45.

If the bit combination in control section 46 indicates that the data section 50 contains message data, decision step 76 compares the transmitted receiver address 51 in data section 50 to each enabled address in storage locations 66, 68 and 70. If the receiver address matches an enabled receiver address in the storage locations, step 78 supplies the message in data section 50 to display 18 (FIG. 3). If the transmitted address 51 in data section 50 does not match an enabled receiver address, decision step 76 returns to step 72 and polls for the next packet 45.

FIG. 5A is a table showing a sample of some different receiver address commands transmitted in control section 46 (FIG. 3) and performed in step 84 in FIG. 4. The control data 46 can command the processor 52 (FIG. 3) to either load, delete, enable or disable different addresses at different receiver storage locations. The specific address loaded or disabled is transmitted in data section 50 of the packet 45.

FIG. 5B is a diagram showing how the receiver 32 polls transmitted data according to enabled receiver addresses. As mentioned above, data is transmitted in a continuous time division multiplexed data stream 130. Multiple time slots of 13.6 milliseconds are grouped together into subframes of approximately 14 seconds. Packets 131 for one or more of the receiver addresses are transmitted in different time slots in the subframe. The same packet is transmitted several times in the same master frame to increase system reliability.

To extend operating life in battery operated receivers, the receiver 32 polls according to enabled receiver addresses. For example, when stored receiver addresses A and B are enabled, the receiver is activated at times 132 and 134. Times 132 and 134 are synchronized with time slots that may contain packets having transmitted receiver addresses matching address A and address B.

Referring to data stream 131, if only receiver address A is enabled in receiver 32, the receiver 32 is only turned on during time period 132. Since receiver address B is not enabled, the receiver 32 does not waste battery power polling time slots containing packets for disabled receiver addresses.

Figure 6:
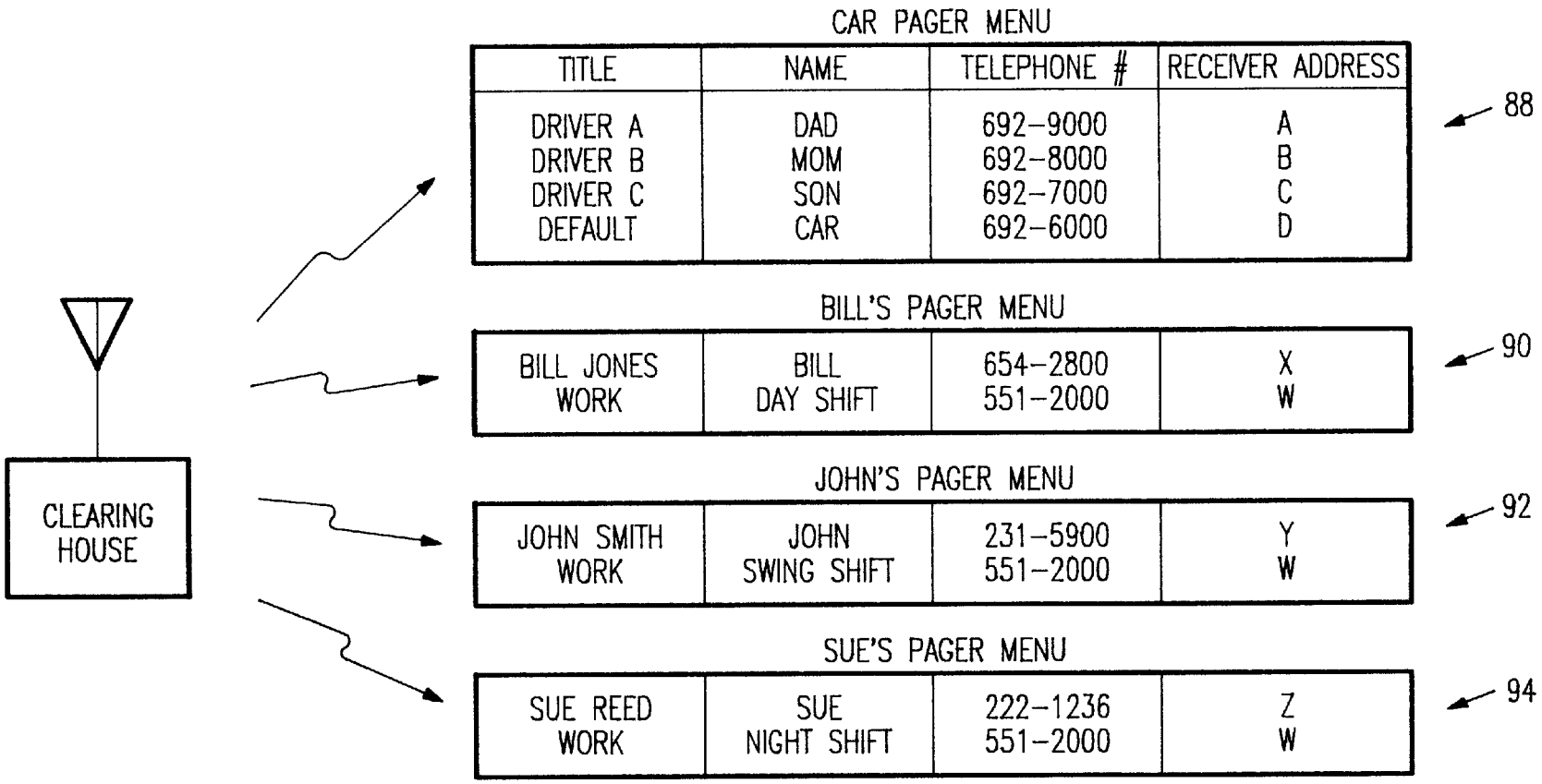
FIG. 6 is a diagram showing different menus for the receivers shown in FIGS. 1 and 2.

FIG. 6 is a diagram showing additional data that is transmitted along with various receiver addresses in data section 50. A menu 88 for receiver addresses in the car receiver shown in FIG. 1 includes a title, name and telephone number for drivers A, B and C and a default address for car 10. The wrist pagers 32, 34 and 36 shown in FIG. 2 store a menu 90, 92 and 94, respectively, which includes a title, name and telephone number for both a personal receiver address and for a work receiver address.

Figure 7:
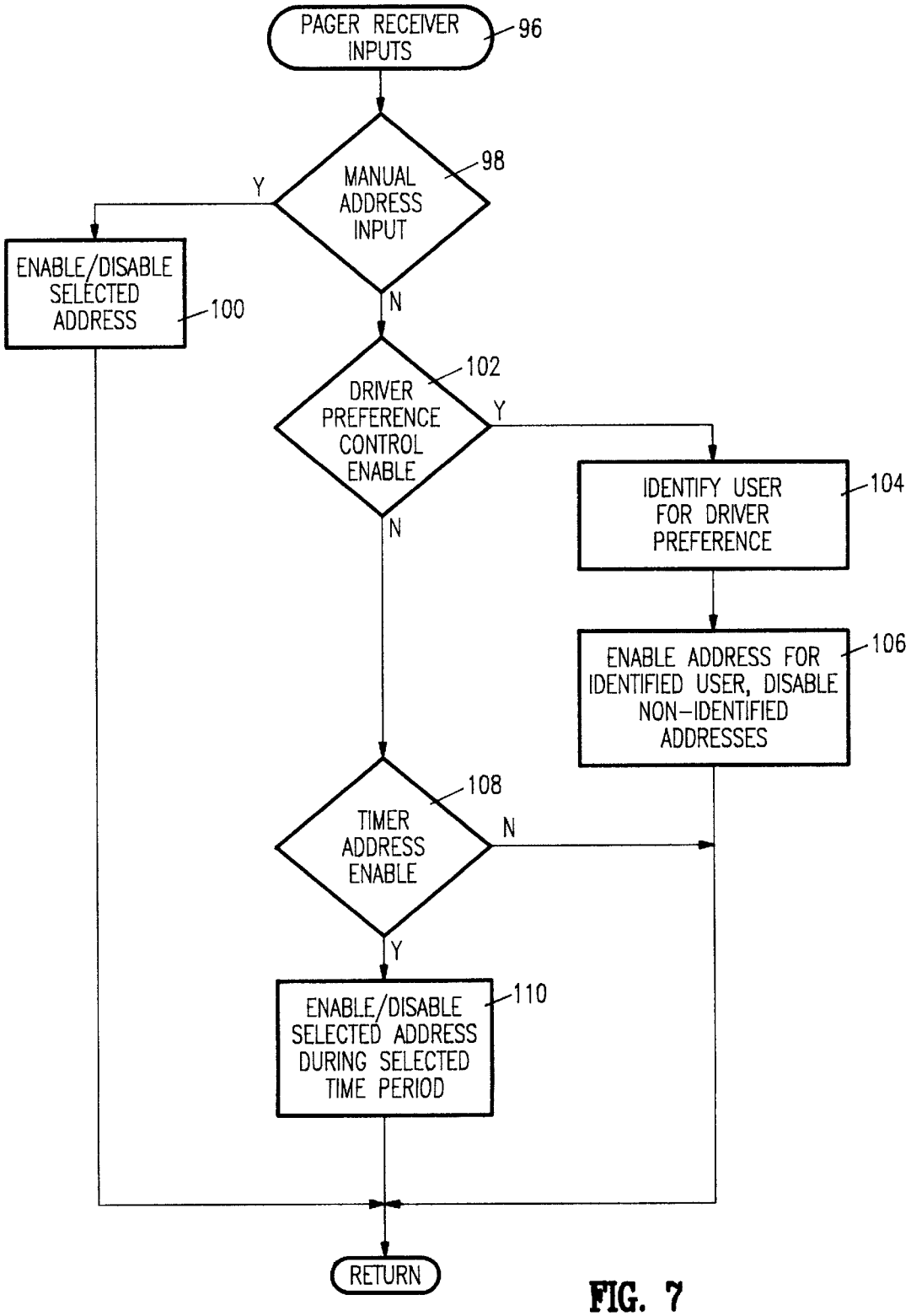
FIG. 7 is a step diagram showing a method for changing receiver addresses with different receiver inputs.

FIG. 7 is a step diagram showing the steps performed by the processor 52 in FIG. 3 when responding to direct user inputs. Step 96 polls for an enable or disable input. Decision step 98 determines if the input comes from the manual buttons. For example, in FIG. 1, processor 52 monitors buttons 22 and in FIG. 2, processor 52 monitors button 42. The selected receiver addresses are enabled or disabled in step 100.

For a car pager, decision step 102 determines if the input signal comes from the driver preference controller 21 (FIG. 1). Step 104 identifies the user according to the driver preference control signals. Step 106 then enables the receiver address associated with the identified user and disables all other receiver addresses.

If decision step 108 determines that the timer 58 (FIG. 3) is selected, step 110 enables the selected address for the selected time period and disables the selected address outside the selected time period. Accordingly, the receiver only polls time slots that may contain messages for selected addresses (See FIG. 5B).

Figure 8:
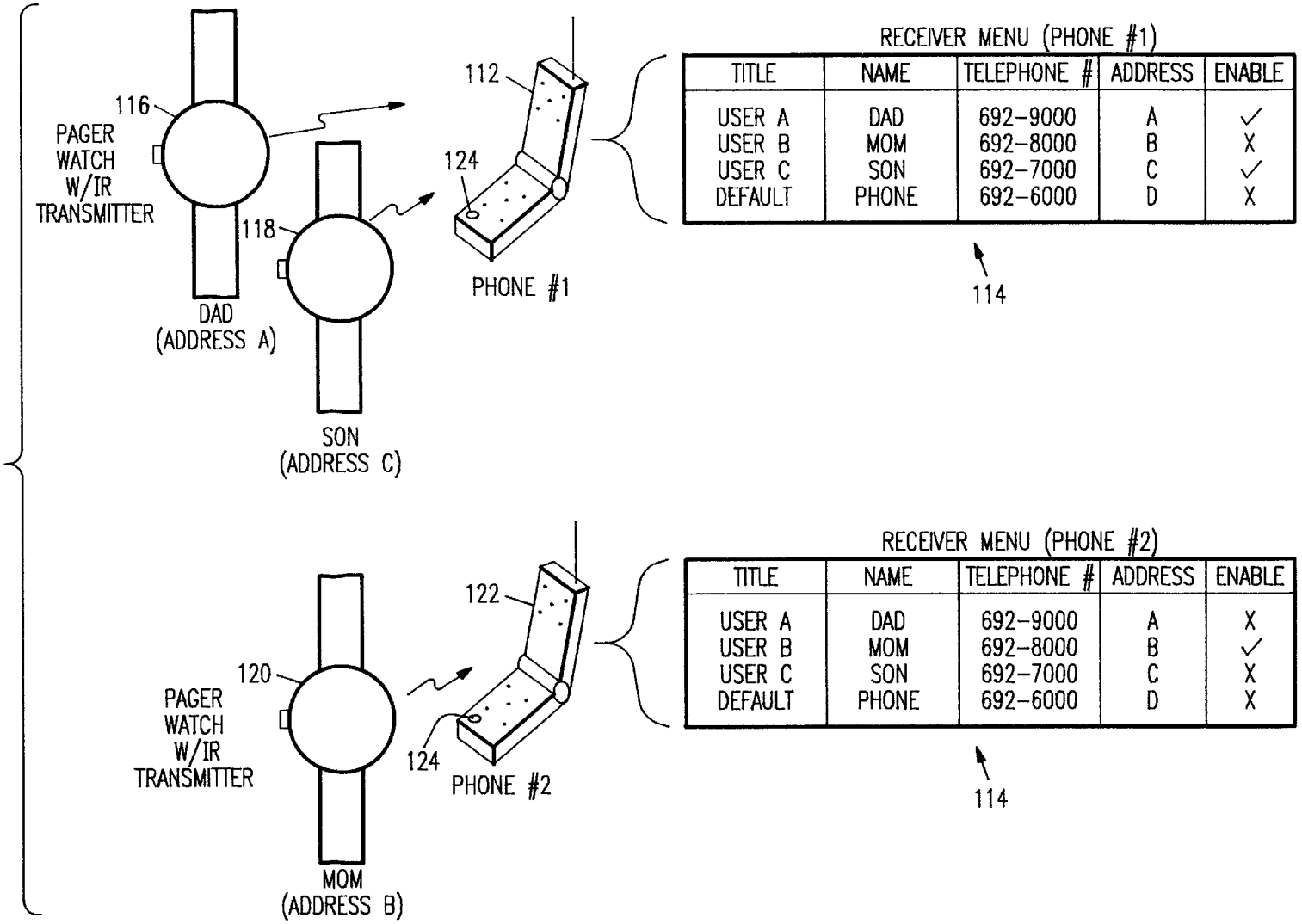
FIG. 8 is a diagram showing cellular telephones with selectable receiver addressing according to another embodiment of the invention.

FIG. 8 is a diagram showing another embodiment of the invention used in conjunction with a cellular telephone system. Cellular telephones 112 and 122 each contain four selectable authorized receiver addresses in menu 114 similar to the menu 16 stored in car pager 12 (FIG. 1). Watches 116, 118 and 120 each transmit an infrared (IR) signal that identify the watch user. For example, watch 116 transmits an IR identification signal associated with address A (Dad), watch 118 transmits an IR identification signal associated with address C (Son) and watch 120 transmits an IR identification signal associated with address B (Mom).

Each cellular telephone 112 and 122 contain receiver circuitry similar to that shown in FIG. 3 and operates in the following manner. If located in the vicinity of cellular phone 112, the IR signals from both watches 116 and 118 enable stored receiver addresses A and C on receiver menu 114. Since only watch 120 is within the vicinity of cellular phone 122, only receiver address B (Mom) is enabled in cellular phone 122. The cellular phones 112 and 122 also include a receiver address select button 124 for manually enabling and disabling the receiver addresses in menu 114.

Cellular phone 112 then only processes calls having telephone numbers matching receiver address A (Dad) or receiver address C (Son). Similarly, cellular phone 122 only processes calls with telephone numbers associated with receiver address B (Mom).

The cellular telephone stores a list of authorized user addresses. For example, both cellular phone 112 and 122 contain only four authorized users (A, B, C, and Default). Calls will not be processed for receiver addresses transmitted from watches that are not included in menu 114. Thus, the system shown in FIG. 8 provides more security than personality modules which can operate on any phone that accepts the modules.

Telephone calls in the system shown in FIG. 8 are also more efficiently transmitted to different cellular phone users than standard cellular phone systems. For example, the mother will not receive telephone calls sent to the son or father's telephone numbers. Thus, money is saved since the mother does not spend phone time answering calls for other family members.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A RF receiver for receiving wireless RF transmission data including associated transmitted receiver addresses, comprising:

an output device for supplying the transmission data;

multiple storage locations containing stored Selectable receiver addresses;

a manually operable selection means located on said receiver for enabling and disabling stored receiver addresses; and a processor coupled to the output device, storage locations and selection device, the processor supplying data to the output device having a data address matching at least one of the enabled receiver addresses.

2. A system according to claim 1 wherein the output device for receiver comprises a visual display and the memory for said said receiver stores a menu containing a list of authorized receiver addresses, the memory supplying the menu to the visual display.

3. A method for selecting user addresses in wireless RF receivers, comprising:

transmitting signals in a time division multiplexed format, the signals including data and associated transmitted receiver addresses;

storing multiple receiver addresses in each one of the receivers, each stored receiver address associated with a different receiver user;

receiving the signals with the RF receivers;

comparing the transmitted receiver addresses with the stored receiver addresses in the receivers;

supplying data in receivers having transmitted receivers addresses matching at least one of the stored receiver addresses; and manually selectively enabling and disabling at said receiver the stored receiver addresses thereby selectively changing the data supplied to the receivers for each user.

4. A method according to claim 3 including enabling a common receiver address in a receiver according to predetermined time periods.

* * * * *